United States Patent [19]

Hirosawa et al.

[11] Patent Number: 4,745,561

[45] Date of Patent: May 17, 1988

[54] CHARACTER FONT PATTERN EDITING SYSTEM FOR MODIFICATION OF FONT PATTERNS

[75] Inventors: Toshio Hirosawa, Machida; Tetsuzou Uehara, Hinode; Tutomu Itoh, Hachiouji; Junichi Kurihara, Hachiouji; Motohide Kokunishi, Hachiouji, all of Japan

[73] Assignee: Hitachi, Ltd., Tokyo, Japan

[21] Appl. No.: 686,659

[22] Filed: Dec. 27, 1984

[30] Foreign Application Priority Data

Dec. 28, 1983 [JP] Japan ..... 58-246276

[51] Int. Cl.[4] ..... B41B 19/00

[52] U.S. Cl. ..... 364/523; 340/751; 340/735; 354/6

[58] Field of Search ..... 364/521, 522, 523; 340/731, 735, 751; 382/47; 354/6

[56] References Cited

U.S. PATENT DOCUMENTS

| | | | |
|---|---|---|---|
| 3,946,407 | 3/1976 | Ishii et al. | 354/6 |
| 4,511,893 | 4/1985 | Fukuda | 354/6 |
| 4,529,978 | 7/1985 | Rupp | 340/735 |
| 4,538,183 | 8/1985 | Kanno et al. | 364/523 |
| 4,555,191 | 11/1985 | Gojo | 340/735 |
| 4,573,199 | 2/1986 | Chen et al. | 340/751 |

OTHER PUBLICATIONS

Applesoft Tool Kit Manual, Apple Computer, Apple Product A2L0038, 1980.

*Primary Examiner*—Russell E. Adams
*Attorney, Agent, or Firm*—Antonelli, Terry & Wands

[57] ABSTRACT

The interactive character font pattern creation, editing and composition control device comprises transforming a printed font into a dot string data of "0", "1" on a drum scanner or the like, expanding the dot string data of font patterns loaded in a font pattern file to a storage to displaying on a display terminal. When a terminal user executes commands for noise deletion, automatic centering, translation, rotation, scaling/zooming, and creation of a revised font pattern through composing a plurality of font patterns to the font pattern given on a display screen, the device applies an operation according to the commands with an original font pattern expanded in the storage as input, loads it then in a storage for storing a current font pattern and displays the current font pattern on the display screen of the terminal.

10 Claims, 7 Drawing Sheets

CHARACTER FONT PATTERN EDITING SYSTEM FOR MODIFICATION OF FONT PATTERNS

BACKGROUND OF THE INVENTION

This invention relates to an interactive character font pattern creation, editing and composition control device for creating and editing interactively character fonts including a logo such as graphic information or the like on a video data terminal or composing a plurality of character fonts, thereby revising character fonts.

In accordance with a development of office automation (hereinafter called OA), there is prevailing recently an available method for creating and editing Japanese documents and English documents in an electronic computer system and formatting these to output to a printer and an output unit connected to a computer. Thus, a substantial advantage of creation and editing of the documents on the computer may be found to realize loading and re-utilization of documents by means of a mass storage function and also enhancement of a formatted output quality according to a high quality output unit.

Referring now to a Japanese document processing (including alphanumeric characters other than kanji), the size of characters formatted for outputting or display on a screen varies from 16-dot square (4 points) to 256-dot square (64 points) or more. Accordingly, characters to cover these sizes will be needed, and further various font styles such as Mincho-style character, gothic style character and the like will be necessary.

Character fonts of these various styles normally create a dot string of "0", "1" by scanning character patterns printed on a printing paper optically using a reader (known as a drum scanner). It is often the case with creation of patterns that an unnecessary dot string (called noise otherwise) may arise on a character font pattern due to an inclination of characters by erroneous setting of the printing paper, a stain on the paper, an erroneous operation of the reader and others. Consequently, a manual retry or a noise deleting operation will be required. For the manual operation, the dot string of "0", "1" must be created by scanning again the printed character patterns optically, which will be ensured by hand repeatedly, and there may be a case where the above operation will take several hours per character, which is very inefficient.

SUMMARY OF THE INVENTION

To cope with the above-mentioned problem, it is a primary object of this invention to provide an interactive character font pattern creation, editing and composition control device wherein a user is capable visually of creating, editing and composing a font pattern through an interactive processing on a terminal ready for displaying a dot string.

For facilitating visual creation, editing and composition of the font pattern through interactive processing, another object of this invention is to provide an interactive character font pattern creation, editing and composition control device, provided with a mechanism for scaling a font pattern with less number of points and so displaying on a screen, zooming to mapping to the dot position of an original font pattern for dot position specification of a pattern for addition or deletion from a terminal, and another mechanism for zooming reversely a font pattern exceeding a display area and so displaying on a screen, scaling to the dot position of an original font pattern for dot position specification of a pattern for addition or deletion from a terminal, thus enhancing an operating efficiency of a terminal user.

The interactive character font pattern creation, editing and composition control device according to this invention comprises transforming a printed font into a dot string of "0", "1" on a drum scanner or the like, expanding a dot string data of the font pattern loaded in a font pattern file (character font dictionary) to a storage, displaying it on a display terminal, operating according to a command given by a terminal user for noise deletion, automatic centering, translation, rotation, scaling or zooming of the font pattern given on a display screen and creation of a revised font pattern through composing a plurality of font patterns with original font pattern expanded in the storage as input, loading it in a storage for current font pattern, and displaying the current font pattern on a display screen of the terminal. The terminal user ensures visually the current font pattern displayed as above, and when decided to be over-edited or the original font pattern is to be displayed again, the original font pattern can be displayed accordingly through a specific command. Further, when editing will have to be applied consecutively to the current font pattern, a command for editing and addition is carried out under the state.

When the font pattern is obtained as desired by the terminal user, a command for loading the font pattern in display on the screen in a font dictionary file is executed, and a dot string data of the font pattern is loaded in the font dictionary file according to the command. Then, when the dot string data of the font pattern is loaded in the font dictionary file, it is cataloged as a revised font pattern. That is, it also functions to add a revised character code to the font pattern and load in the font dictionary file as a character font record.

DESCRIPTION OF THE PREFERRED EMBODIMENTS

The invention will now be described in detail according to one preferred embodiment with reference to the accompanying drawings.

Figure 1:
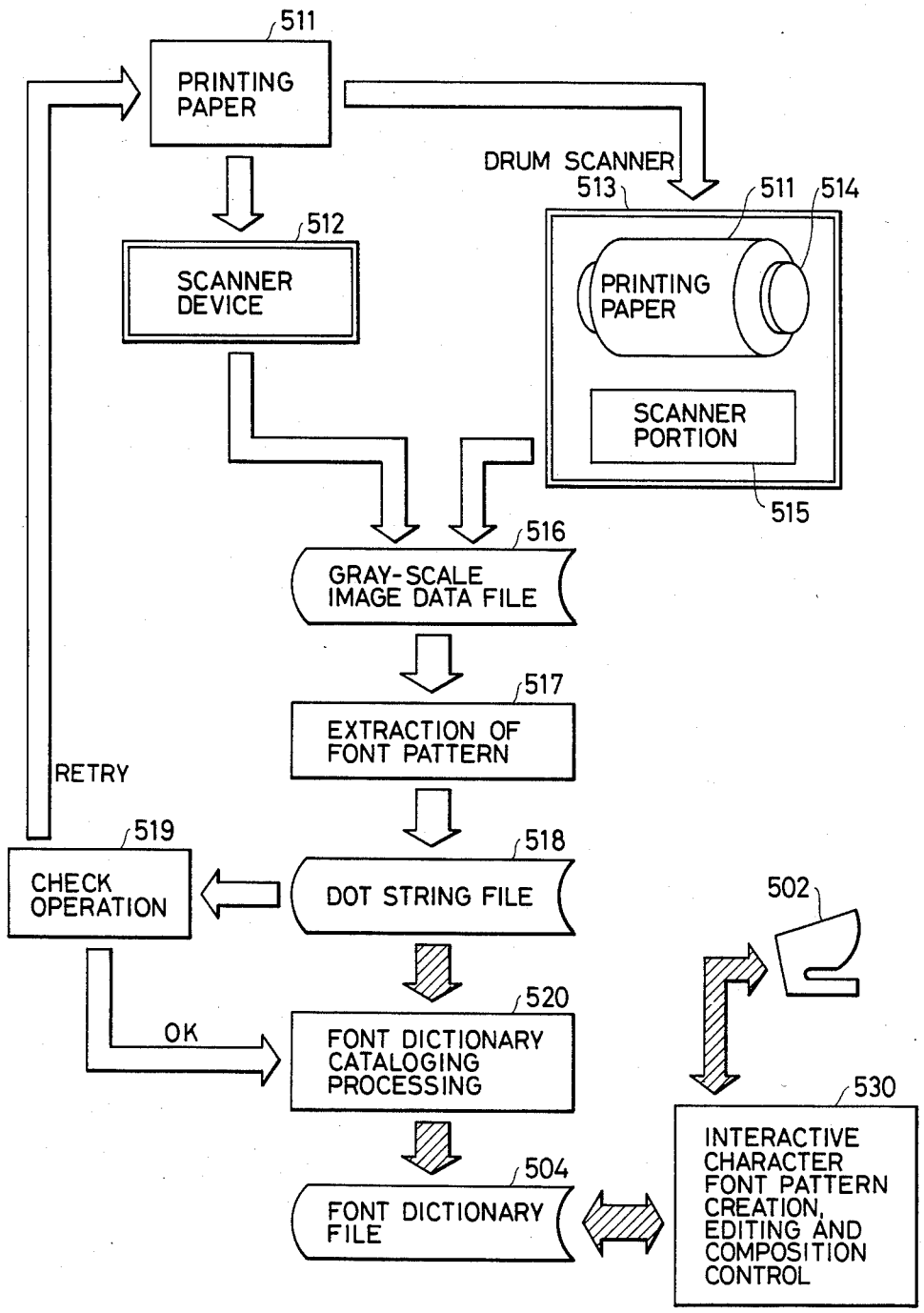
FIG. 1 is an explanatory drawing showing a relation between a procedure for creating character font data and an interactive character font pattern creation, editing and composition control device of this invention.

FIG. 1 is a conception drawing for describing a procedure for creating character fonts separately by a conventional system and a system according to this invention.

A character font is created generally as follows. First, a character to be cataloged in a font dictionary file 504 is printed on printing paper 511. Next, the printing paper 511 on which the character has been printed is read in a scanner device 512 or a drum scanner 513. Here, the scanner device 512 and the drum scanner 513 function in operation, to create gray-scale image data with the printing paper 511 as an input.

In the drum scanner 513, a drum 514 rotates with the printing paper 511 wound thereon. A scanner portion 515 scans the drum 514 transversely (in a raster direction) in an optical manner, thereby creating the gray-scale image data in each raster direction of the printing paper 511. As represented by a facsimile device, the scanner device 512 scans as it takes in the printing paper 511.

The gray-scale image data created by the scanner device 512 or the drum scanner 513 is loaded in a gray-scale image data file 516. Here, the grayscale image data in the gray-scale image data file 516 has 1 pixel indicated by a plural bits, and a gray level of the pixel is indicated by the value thereof. For example, if 1 pixel is represented by 8 bits, then it provides gray-scale information for 256 gray levels. The number of characters printed on the printing paper 511 is about 192 in case, for example, the paper size is B4 and the character is 1 cm square. Then, the time required for loading the image data in the gray-scale image data file 516 is about 1 hour per printing paper. The time comes in about 30 minutes for setting the printing paper 511 and about 30 minutes for operation of the scanner device 512 and loading in the gray-scale image data file 516. The scanner device 512 requires such a long time for operation when it is operated at 10 rasters per mm vertically, and an increased resolution may increase the operating time.

Next, with the gray-scale image data file 516 as an input, an extraction of font patterns 517 comprises transforming into a binary information string of "0", "1" (dot string) under the gray-scale image information corresponding to 192 characters printed on one printing paper 511, thereby creating a dot string data corresponding to individual character. The dot string data created to correspond to the character is loaded in a dot string file 518. Generally, the extraction of font patterns 517 is processed on an electronic computer, and the time required therefor is about 2 hours per printing paper including a waiting time for job running.

In a conventional procedure for creating character font patterns, a manual check operation 519 is carried out. The check operation 519 ensures that a dot pattern of the character font has been created normally through (1) printing the character font pattern on a raster type dot printer, or (2) outputting the dot data by means of a laser beam printer. The check operation 519 is carried out manually for checking the inclination of characters, noise, extraction of character patterns, and others.

The check operation 519 covers an extensive range from 4 points (16-dot square or about 1.4 mm square) in character size to 64 points (256-dot square or about 225 mm square), therefore a visual operation involves significant difficulty.

The check operation normally takes about 10 minutes per character and also a certain level of skill. If it is decided that the dot pattern is not acceptable as a result of the check operation 519, then the procedure must be recommenced from setting the printing paper 511, for which about 3 hours will be necessary.

On the other hand, when the dot string data of the character font is decided to be normal by the check operation 519, a font dictionary cataloging processing 520 is executed. With the dot string file 518 as an input, the font dictionary cataloging processing 520 catalogs a character code corresponding to the character font in the font dictionary file 504 as an added character font record.

The conventional procedure for creating character fonts is as described above, which requires considerable time and labor for creating character fonts. Then, the interactive character font pattern creation, editing and composition control device according to this invention is constituted, with the font dictionary file 504 of FIG. 1 as an input, of a display terminal 502 and an interactive character font pattern creation, editing and composition control 530, which is capable of creating, editing or composing character font patterns. That is, as indicated by an arrow with hatching, a dot string of the dot string file 518 is once cataloged in the font dictionary file 504 through the font dictionary cataloging processing 520 without performing the check operation 519, and processings for ensuring, editing, adding and composing the character font patterns will be carried out by means of the display terminal 502. Thus, the above-described retry operation can be avoided.

Now, the configuration and operating method of the interactive character font pattern creation, editing and composition control device according to this invention will be described in detail with reference to FIG. 2 to FIG. 9.

Figure 2:
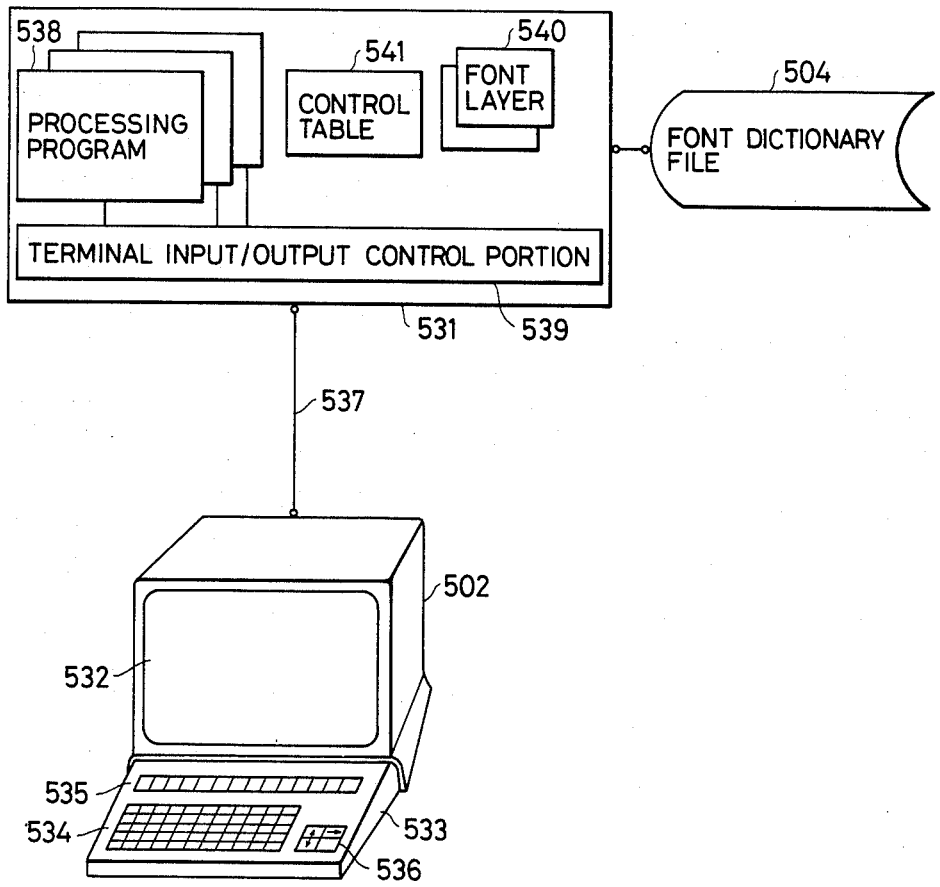
FIG. 2 is an explanatory drawing showing schematically a configuration and environment of the device according to this invention.

FIG. 2 represents a configuration of the interactive character font pattern creation, editing and composition control device. The control device comprises a central processing unit 531 having a main storage and an arithmetic operation capacity, the font dictionary file 504 for loading character font patterns, and the display terminal 502.

The interactive character font pattern creation, editing and composition control 530 in FIG. 1 is executed on the central processing unit 531.

The display terminal 502 comprises a display screen 532 and a keyboard 533, of which the keyboard 533 has an alphanumeric character and kana-key portion 534, a function key (PF) group 535, and a cursor position control key 536. Then, FIG. 2 represents an example wherein the central processing unit 531 and the display terminal 502 are connected through a signal cable 537, however, the central processing unit 531 and the display terminal 502 can be integrated in configuration.

The interactive character font pattern creation, editing and composition control 530 in the central processing unit 531 comprises a terminal input/output control portion 539, a processing program group 538 provided correspondingly each to a plurality of commands inputted from the keyboard 533, and a control table 541 retained in expansion to the main storage.

An editing operator of the font pattern inputs a character code and a character font display command corresponding to the character font to be ensured and edited by combining the alphanumeric key 534 from the keyboard 533 of the display terminal 502. The terminal input/output control portion 539 interprets the inputted character code and command, selects the corresponding processing program from among the processing program group 538, and delivers a control to the corresponding processing program. The processing program executes a processing according to an input of the cursor position control key and others.

The corresponding processing program reads a font pattern corresponding to the character code out of the font dictionary file 504, expands it to any one font layer of a font layer group 540, and displays the dot pattern on the display screen of the display terminal 502. In this case, control information such as the character code currently in process, the address of the font layer and others is loaded in the control table 541.

The terminal user checks visually the font pattern displayed on the screen 532 and if editing, addition or deletion are necessary, issues a necessary command by means of the function key 535 or the alphanumeric character key 534. Then the terminal input/output control portion 539 interprets the command, selects the corresponding processing program from among the processing program group 538, and abandons a control to the corresponding processing program. The corresponding processing program then selects a font layer to process from among the font layer group 540 by means of the control table 541, applies processings of translation, automatic centering, noise deletion and others to the font layer selected as above, and displays the result again on the display screen 532.

Here, when a desired character font pattern is obtained after ensuring the edited result visually, the terminal user issues a command for reloading the character font pattern in the font dictionary file 504. The corresponding processing program operates according to the command, and the font layer is loaded in the font dictionary file 504.

The above description refers to an operative example of the interactive character font pattern creation, editing and composition control device. Time and labor for the conventional font creating procedure can be saved sharply by this embodiment.

Described next are the detailed configuration and operative example of the processing program group 538, the terminal input/output control portion 539, the control table 541, and the font layer group 540.

Figure 3:
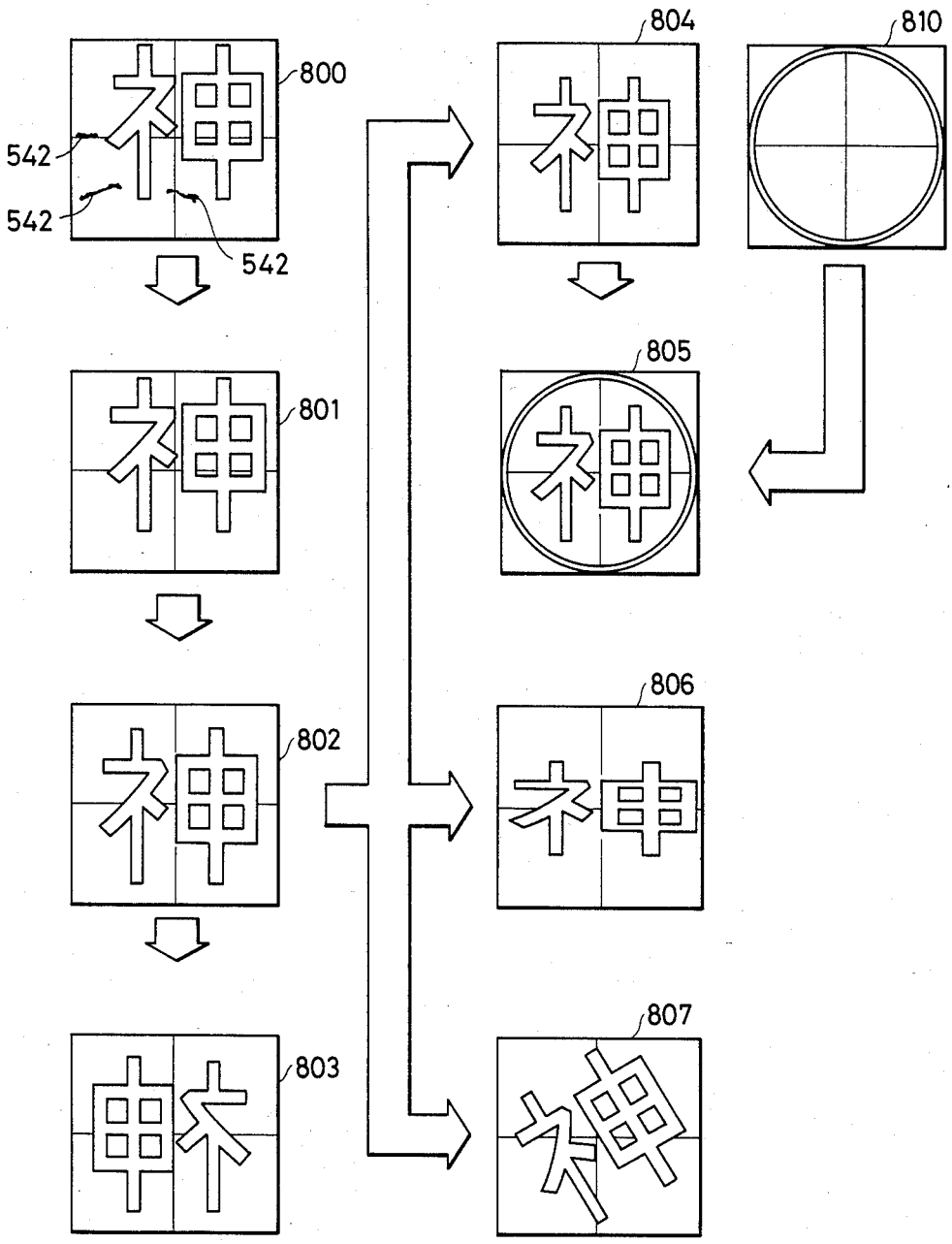
FIG. 3 is an explanatory drawing showing examples of creation, editing and composition of character font patterns effected by the interactive character font pattern creation, editing and composition control device of this invention.

FIG. 3 is a drawing representing editing and composition examples of character font patterns by the interactive character font pattern creation, editing and composition control device according to this invention. A reference numeral 800 represents a state in which a font pattern 神 in the font dictionary file 504 after the font dictionary cataloging processing 520 shown in FIG. 1 is displayed on the display screen 532. In the display state 800, 542 denotes noise when the printed character is read on the drum scanner 513. The terminal user will delete the noise 542 first in the display state 800. The command is given on the function key group 535, and item No. 1 or 2 will be used from among function keys shown in Table 1.

TABLE 1

| Item No. | Function key | Function | Description |
|---|---|---|---|
| 1 | PF1 | Deletion of a dot, line and plane | A dot, line, plane specified by cursor are deleted. |
| 2 | PF2 | Deletion of outer frame | Dot outside the frame specified in cursor range is deleted. |
| 3 | PF3 | Automatic centering | Character font pattern is automatically centered. |
| 4 | PF4 | Translation | Specified number of dots is translated vertically and horizontally. |
| 5 | PF5 | Addition of a dot, line, plane | Dot data is added to a dot, line, plane specified by cursor. |
| 6 | PF6 | Expanded display of character font pattern | Character font pattern is expanded to display. |
| 7 | PF7 | Zoomed display of character font pattern | Character font pattern is zoomed to display. |
| 8 | PF8 | Composition of character font patterns | Other character patterns are composed to a revised character font. |
| 9 | PF9 | Loading in character font file | Font pattern in display is loaded in character font file. |
| 10 | PF10 | Cataloging of character font | Character code is added to create a character font record, which is loaded in character font file. |
| 11 | PF11 | Restoration of character font | Returned to one precedent operating state to display. |
| 12 | PF12 | Display of original character font pattern | Reread from character font file to display. |
| 13 | PF13 | Creation of character font with revised number of points through scaling/zooming | Character font different in number of points (dot, size) is created. |
| 14 | PF14 | Rotation of character font | Rotated counterclockwise by angle so specified. |

When the function key PF1 is used, the processing program corresponding thereto is activated, and a dot, line or plane specified by the cursor is deleted. This is realized by writing "0" in a cursor-speicfied coordinate of the font layer. Then, when the function key PF2 is used, the processing program 538 corresponding thereto is also activated, and a dot outside the frame specified in a cursor range is deleted. This is also realized by writing "0" in a coordinate outside a cursor-specified range of the font layer. A reference numeral 801 denotes a display state after deletion of the noise 542. At this point in time, the font pattern 神 is dislocated right upward due to a dislocation of the printing paper 511. Now, therefore, the terminal user may specify No. 3 function key for automatic centering command from those of Table 1. The corresponding processing program is activated by the command, and the font pattern 神 is centered in the frame as shown in a display state 802. The terminal user then loads the character font pattern thus completed in the font dictionary file 504. The command is made by No. 9 function key of Table 1.

Next, a creating example of a revised character font will be described. A display state 803 is an example in which the character font pattern 井 is translated horizontally.

The corresponding processing program is activated according to the command of No. 4 function key PF4 of Table 1, and the horizontal translation is specified by keying in a sub-parameter requested for input by the program.

A display state 804 is that in which an 88% zooming is applied to the character font pattern of the display state 802, and the character font pattern is zoomed by specifying No. 7 function key of Table 1. The pattern zooming can be realized on a technique described, for example, in "Automatic Scaling of Print Fonts", IBM R & D R. G. Casey, Nov. 1982.

Further, a display state 805 indicates an example in which a special character font ○ is created by composing the character font pattern of the display state 804 and the font pattern "⊕" of a display state 810. This is obtainable through specifying No. 8 function key PF8 of Table 1.

A display state 806 is that for which scaling and zooming are combined, which is realized by the function key PF13. A display state 807 is that for which the character font pattern 井 is rotated 30 degrees counterclockwise, which by the function key PF14. A dot data is added to dot, line and plane specified by the cursor by specifying the function key PF5. The character font pattern is expanded by the function key PF6. A character code is added by the function key PF10 to obtain a character font record, which is loaded in the character font file. Returning to one precedent operating state to display is effected by the function key PF11. Reread from the character font file to display is effected by the function key PF12. Operations of the function keys PF1 to PF14 will be described in detail later. As described above, an assignment of new character codes to the display states 803 to 807 may avoid the necessity to create dot strings of the character font anew from the printing paper 511, thus creating revised character font patterns. Further, a character font pattern which is different in the number of points can also be created easily.

Figure 4:
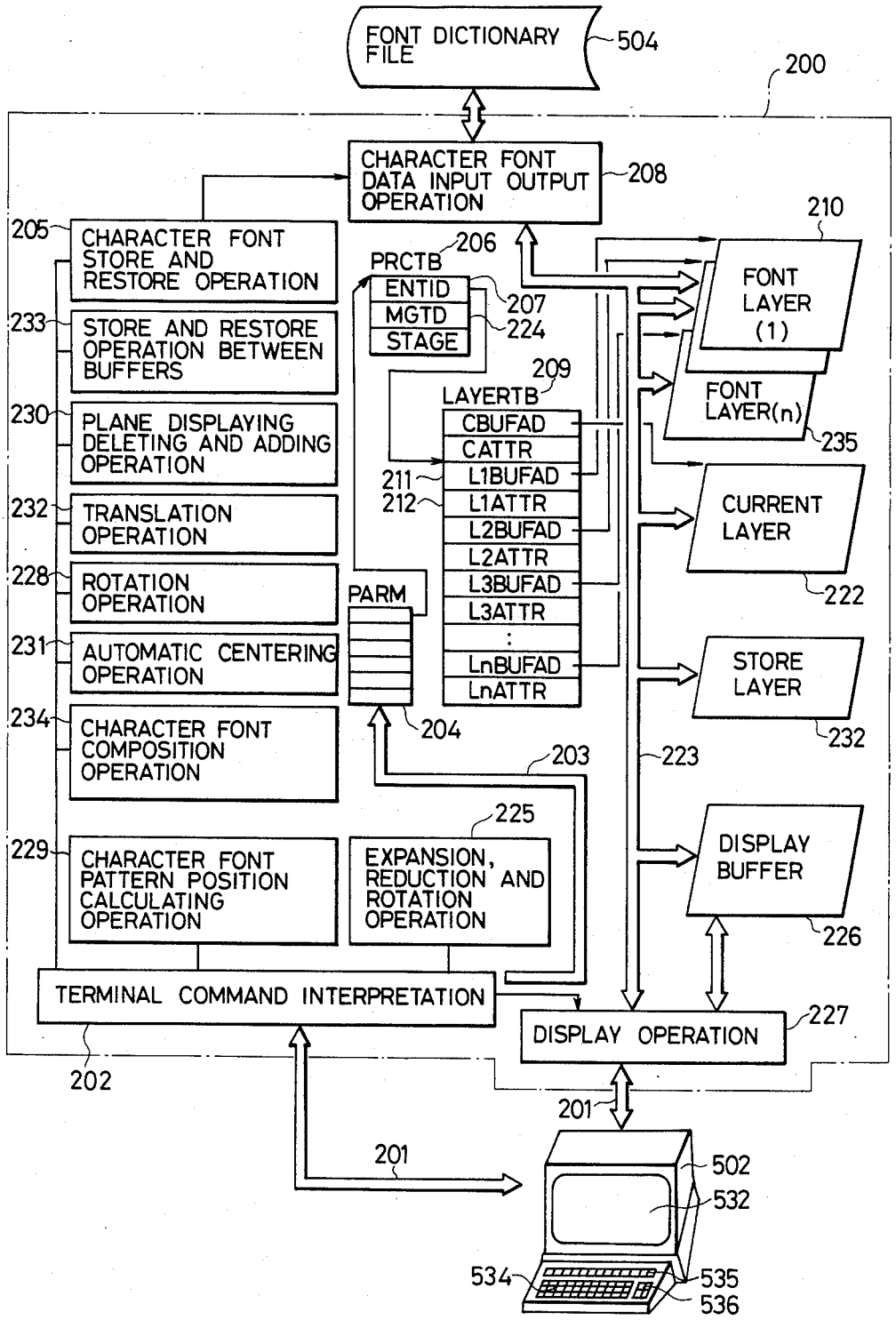
FIG. 4 is an explanatory drawing representing in detail a relation between a processing program group of the invention shown in FIG. 3 and a layer group for loading control table font patterns.

FIG. 4 is a drawing representing in detail a relation among the processing program group 538, the control table (CTL) 541, the font layer group 540 and others in the character font pattern creation, editing and composition device shown in FIG. 2. In FIG. 4, a reference numeral 200 denotes a main memory in the central processing unit 531 of FIG. 2. Accordingly, the above-mentioned processing program group 538, control table (CTL) 541, font layer group 540 and others are present in the main memory 200.

Information of the command from the display terminal 502 through the function key group 535 is delivered to a terminal command interpretation control 202 through a data line 201. In the terminal command interpretation control 202, command information such as character code, character font size, command classification and the like is interpreted, the information is loaded in a parameter table (PARM) 204 through a data line 203, and then control is delivered to a character font store and restore operation 205. According to the parameter table (PARM) 204, the character font store and restore operation 205 recognizes a restoration of the character font, and prepares for reading a font pattern of the character code from the font dictionary file 504. That is, a dead layer number is set in a layer number (ENTID) 207 of a control table (PRCTB) 206, and the control is delivered to a character font data input/output operation 208.

The character font data input/output operation 208 reads a font pattern record corresponding to the character code out of the font dictionary file 504, and loads the dot data of the font pattern in a font layer 210. In FIG. 4, assuming that the number of the layer number (ENTID) 207 of the control table (PRCTB) 206 is 1, information of the corresponding font layer 210 will be present at the first entry of a layer control table (LAYERTB) 209. There are addresses LnBUFAD 211 and LnATTR 212 of the layer present in each entry of the layer control table (LAYERTB) 209. Here, "n" represents an entry number and is equivalent to a value of the layer number (ENTID) 207. Accordingly, if the entry number is 1, "n" becomes 1, thus LnBUFAD, LnATTR are L1BUFAD, L1ATTR respectively. L1BUFAD holds an address of the layer and indicates the font layer 210 in the example of FIG. 5.

Figure 5:
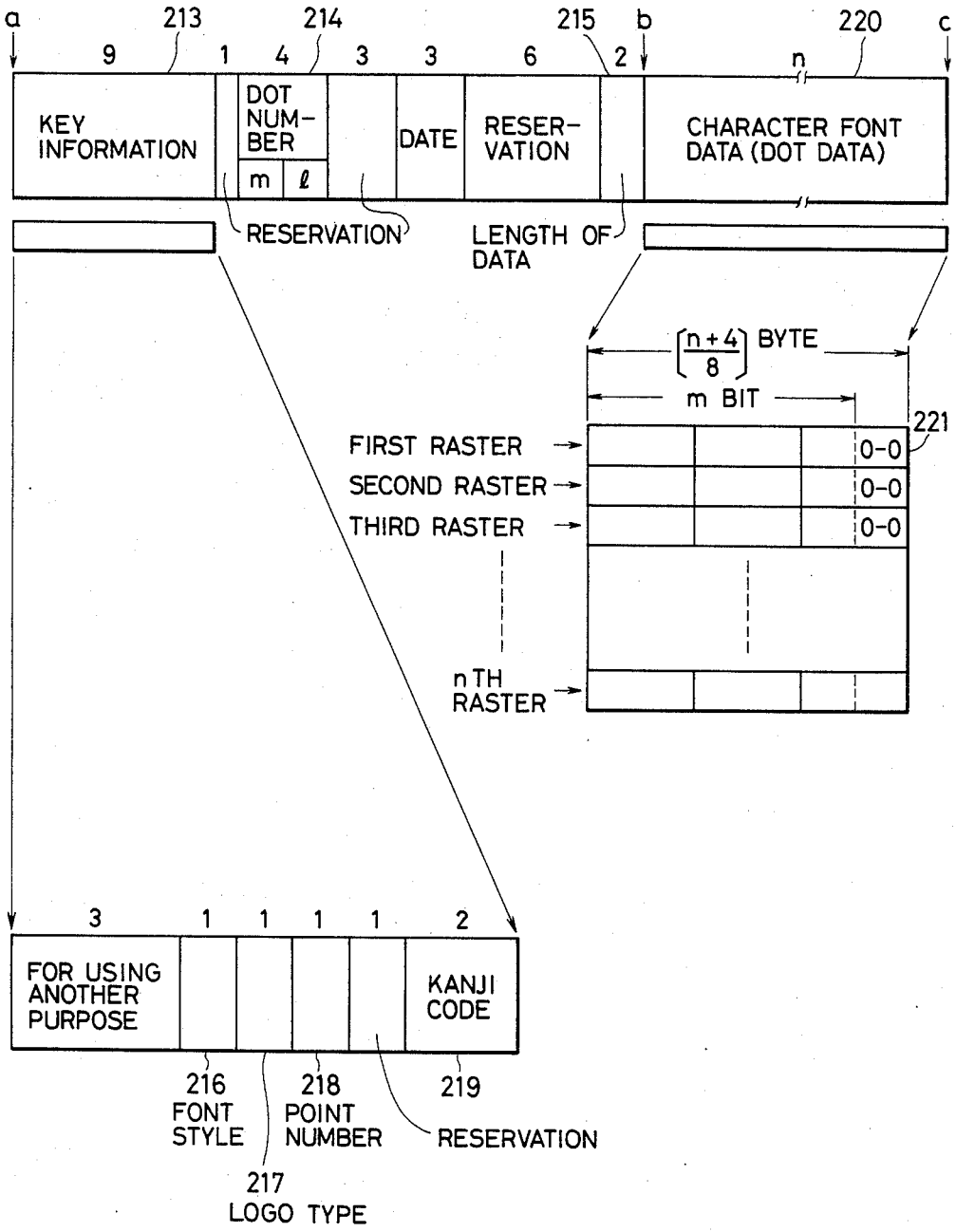
FIG. 5 is an explanatory drawing showing a format of the font record loaded in a font dictionary file.

L1ATTR 212 loads font style, number of points, number of dots, data length of the character font pattern and others as values of attribute of the character code. That is, the font pattern record in the character font dictionary file 504 has a format shown in FIG. 5, and key information 213, dot number 214, and length of data 215 of FIG. 5 are loaded in L1ATTR 212. The key information 213 is constituted of font style 216, logo attribute 217, number of points 218, kanji code 219 and others. Here, the font style 216 is that of identifying a Mincho-style character or a gothic-style, and the logo attribute 217 is that of identifying a character or a graphic figure of a character font data 220. Numerical values given on that of indicating a format of the font pattern record in FIG. 5 denote a necessary number of bytes. Then, the character code loaded in the parameter table (PARM) 204 is set at a value specified by the terminal user.

The dot data 220 of a character font data in the character font pattern record covers an area from a point b to a point c. The loading format is given in a raster unit as indicated by a reference numeral 221 in FIG. 5. In the case of a font pattern m dots laterally and n dots vertically, for example, each dot is made to correspond to a bit, and a byte number to satisfy m bits is secured for the raster unit. Here, 1 byte comes in 8 bits.

Accordingly, only a font pattern $m \times n$ bits will be expanded in the font layer 210 of FIG. 4. Then, the byte number necessary for loading the font pattern is stored in the length of data 215 of FIG. 5.

Referring again to FIG. 4, when the dot data of the font pattern is expanded in the font layer 210, the font layer 210 is copied on a current layer 222. The reason is that editing, adding and deleting operations to the font pattern are carried out to the current layer 222. Then, the copying operation is effected through a data line 223, and the control is made at the terminal command interpretation control 202.

Here, the dot data of the font pattern expanded in the current layer 222 is displayed on the screen 532, however, if the font pattern 8 points (32 dots$\times$32 dots) in character size is displayed on the screen 532, then the displayed font pattern is too small to decide where to edit for the terminal user.

Now, therefore, the terminal user will find it difficult to check visually and if a command is given to that effect, then the terminal command interpretation control calculates a scaling value from sizes of a display area of the display screen 532 and the font pattern, and loads the value in a scaling/zooming value (MGTD) 224 in the control table (PRCTB) 206. The control is then delivered to an expansion, reduction and rotation operation 225. As a matter of course, a reduction operation will be effected where the font pattern is larger in size than the display screen area 532.

With a value of the scaling/zooming value (MGTD) 224 as a reference, an expansion and reduction operation is applied to the current layer 222, and the result is loaded in a display buffer 226. Thus, a display operation 227 displays the content of the display buffer 226 on the display screen 532 of the terminal device 502. Now, the terminal user is ready for commanding editing, deletion, addition or composition of font patterns shown in the example of FIG. 3 to the displayed font pattern.

Next, an expanded display operation of the dot pattern and a dot position mapping method to the current layer 222 will be described with reference to FIG. 6 and FIG. 7.

Figure 6:
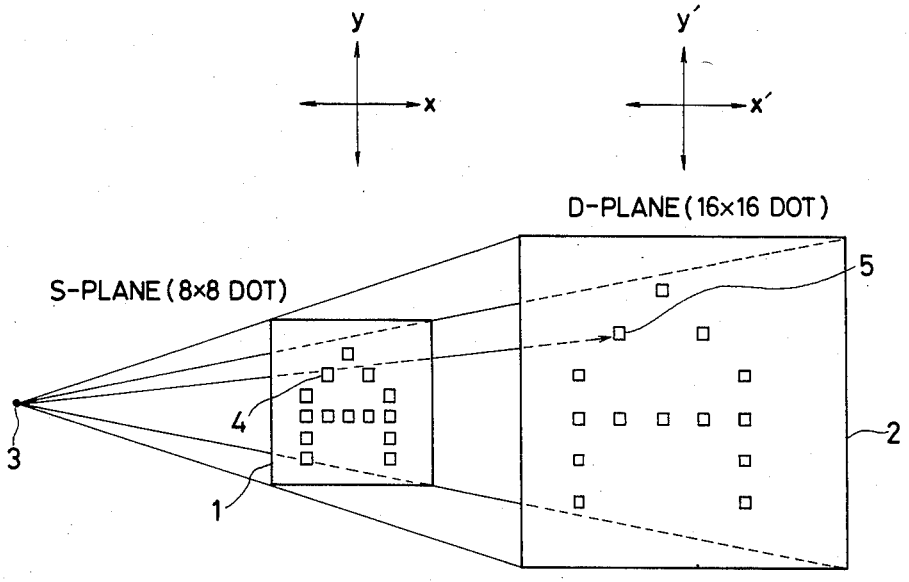
FIG. 6 is an explanatory drawing indicating a problem when a general graphic data is expanded in dots.

FIG. 6 is a drawing representing an example of a character "A" of the character font being expanded as a dot string. In FIG. 6, 1 denotes a plane of BE data, which is referred to as an S-plane. Then, the S-plane 1 corresponds to the current layer 222 of FIG. 5. A reference numeral 2 denotes a plane after the data is expanded, which is referred to as D-plane. The D-plane 2 corresponds to the display buffer 226 of FIG. 4. Then, 3 denotes a focus, 4 denotes dot position data on the S-plane 1, and 5 denotes dot position data on the D-plane 2. Further, an origin of coordinates of the S-plane 1 and D-plane 2 exists at the center, which can be expressed as x-y axis and x'-y' axis respectively.

For the expansion operation, the focus 3 is set, and a coordinate value with a value of each dot position on the S-plane 1 given at "1", or the dot position data 4 for example, is projected on the dot position data 5, which can be expressed and so known generally as follows.

$$\begin{pmatrix} x' \\ y' \end{pmatrix} = \begin{pmatrix} Sx & O \\ O & Sy \end{pmatrix} \begin{pmatrix} x \\ y \end{pmatrix} \quad (1)$$

where Sx is a scaling value in the x-axis direction, Sy is a scaling value in the y-axis direction, x, y are coordinate values within the S-plane 1, and x', y' are coordinate values within the D-plane 2.

The expression (1) means an expansion of analog data processing projected and expanded from the focus 3. Accordingly, when the expression (1) is applied to a coordinate of each dot position on the S-plane 1, the expression (1) is also to be applied to the digital data, and the coordinate value "1" in dot value is reflected on a coordinate value on the D-plane 2. That is, as shown in FIG. 6, if the S-plane 1 8×8 dots is expanded to the D-plane 2 16×16 dots, then the dot position data 4 is projected on the dot position data 5 by 1 dot, and the character "A" on the D-plane 2 has each dot isolated. This is so caused by each dot position coordinate being subjected to a one-to-one mapping between the S-plane 1 and th D-plane 2.

Consequently, in the expansion, reduction and rotation operation 225, a coordinate value of the S-plane 1 corresponding to the coordinate value of the D-plane 2 is calculated, and if the value of dot position on the S-plane 1 is "1", then the dot value of the corresponding coordinate value on the D-plane 2 is taken at "1". A skipped displaying shown in FIG. 6 is thus prevented thereby, and an expanded dot pattern is obtainable on the D-plane 2 as shown in FIG. 7. The operation is referred to as back mapping of a coordinate value.

Figure 7:
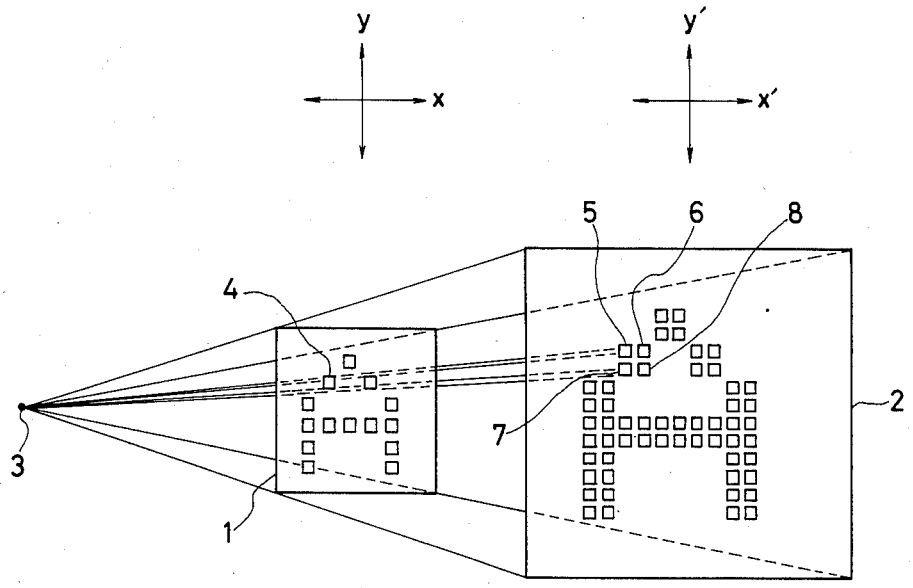
FIG. 7 is an explanatory drawing representing a scaling system for general graphic data including the font pattern employed by the device of this invention and an addressing method for coordinate position.

In FIG. 7, reference numerals 1 to 5 are identical in semantics to those of FIG. 6, and reference numerals 6 to 8 represent dot position data with values "1" each as coordinate value on the D-plane 2, as a value of the dot position data 4 on the S-plane 1 is "1" when the coordinate value on the D-plane 2 is subjected to back mapping.

The back mapping of the coordinate value from the D-plane 2 to the S-plane 1 will be made against the expression (1), as:

$$\begin{pmatrix} x \\ y \end{pmatrix} = \begin{pmatrix} \frac{1}{Sx} & O \\ O & \frac{1}{Sy} \end{pmatrix} \begin{pmatrix} x' \\ y' \end{pmatrix} \quad (2)$$

If values of Sx, Sy in the expressions (1) and (2) are smaller than 1, then a reduction operation is made to a graphic data.

For a character font pattern position calculating operation 229, a coordinate position will be calculated with a rotated angle $\theta$ as 0 in an expression (4). Concretely, if the terminal user specifies any one of the dot position data 5 to 8 of FIG. 9, then the dot position 4 on the S-plane 1 can be specified. That is, a coordinate value address on the display buffer 226 of FIG. 4 is transformed into the coordinate value address in the current layer 222, and thus the font patterns shown in FIG. 3 are ready for editing, addition and deletion.

Function keys and processing contents thereof will now be described as follows:

(a) Function keys PF1, 2 and 5

For plane displaying, deleting and adding operation of FIG. 5, if the terminal user specifies a rectangular area by means of the cursor position control key 536 and then specifies the plane deletion, addition and others, then addition and deletion of the dot pattern corresponding to the command will be carried out on the current layer 222.

(b) Function key PF3

When the function key PF3 is operated, the automatic centering operation 231 calculates a center position of the font pattern, and translates the center position to that of the current layer 222.

(c) Function key PF4

For back mapping of the translation, if Dx is a movement in the x-axis direction and Dy is a movement in the y-axis direction, then the following expressions (3), (4) hold:

$$x = x' - Dx \ldots \quad (3)$$

$$y = y' - Dy \ldots \quad (4)$$

A character font is translated in the current layer 222 by inputting the function key PF4 to specify Dx and Dy. The processing is effected by the translation operation 232.

(d) Function keys PF6, 7

The expansion operation is obtained when Sx, Sy are kept larger than 1 in the expression (1). Then, the reduction operation is obtained when Sx, Sy are kept smaller than 1.

The expansion, reduction and rotation operation 225 works to processing in the current layer 222 by inputting Sx and Sy after the function keys PF6, 7 are inputted.

(e) Function key PF8

A composition operation of character font patterns will be described, next. The operation is activated by the function key PF8 and effected by a character font composition operation 234 of FIG. 6. A composition of character font patterns is to create a revised character font by overlaying a plurality of font layers 210, 235 shown in FIG. 4. The terminal user may make a command, for example:

$$CMP_{\Delta}\ Ln_{\Delta}\ Lm_{\Delta} \ldots$$

"CMP" is semantic here of a composition command, and Ln, Lm and so on are layer (ENTID) numbers 207. The character font composition operation 234 refers to the control table (LAYERTB) 309, locates the entry number specified by Ln, Lm, and thus obtains an address of the corresponding font layer. Next, these font layers are copied in sequence on the current layer 222. An example of the operation will be described with reference to FIG. 8.

Figure 8:
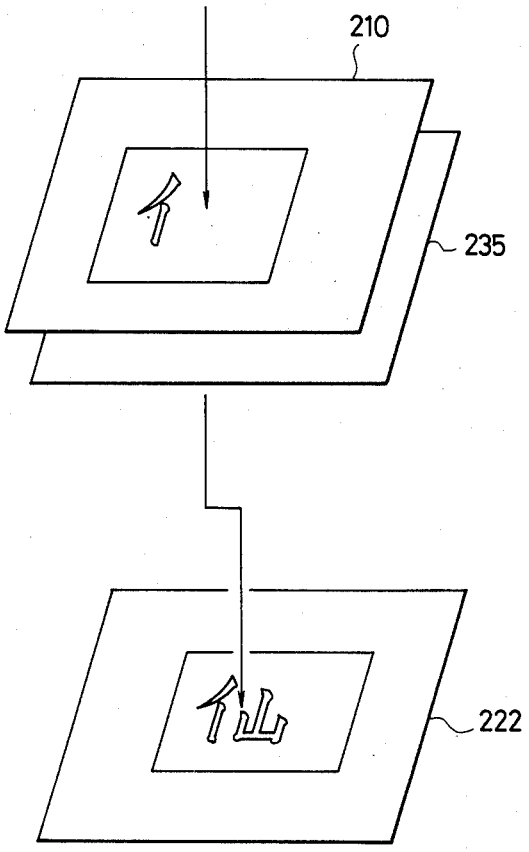
FIG. 8 is an explanatory drawing representing a conception wherein a revised font pattern is created by composing font patterns.

In FIG. 8, the font layer 210 has, for example, a font pattern "λ", and the font layer 235 has a font pattern "ﻻ". An operation for creating the character font pattern "ﻻ" will be described. First, the font layer 210 is moved to the current layer 222. Next, it is translated leftward under the current layer 222. The command may be made by the terminal user on No. 4 function shown in Table 1. After the translation is over, the font pattern of the current layer 222 is returned to the font layer 210. Next, the font pattern of the font layer 235 is transferred to the current layer 222. It is translated, if necessary, rightward. Then the current layer 222 is again returned to the font layer 235. The preparations are thus completed for composition of character font patterns.

Next, dot data of font patterns of the font layer 210 and the font layer 235 may be transferred to the current layer 222.

The above-described composition example of font patterns covers a case where two font patterns are composed, however, the number of the font patterns to be overlaid may be three or over.

(f) Function keys PF9, 10

An operated result is displayed on the screen 532 of the display terminal 502. The terminal user will check visually the character font pattern displayed on the screen 532. If the font pattern is identified as desired by the terminal user, then character code, point number and others are assigned to the font pattern, which is cataloged in the font dictionary file 504.

Then, where there is no modification made to the character code likewise, the font pattern being displayed is cataloged in the font dictionary file with the character code left as it is from specifying the function key PF9.

(g) Function key PF11

Expansion, reduction, composition, translation and the like of character fonts are all operated in the current layer 222, however, in advance to executing operations according to commands of the terminal user, a dot position data of the current layer 222 is stored in a store layer 232. Accordingly, when the terminal user specifies the function key PF11 from among those of Table 1, a store and restore operation between buffers 233 operates, and a dot data of the font pattern in the store layer 232 is returned to the current layer 222.

Thus, the state can be returned to the prior command-operated state.

(h) Function key PF12

When No. 12 function key of Table 1 is specified for operation of the function key PF11, a character font record is read anew from the font dictionary file 504.

(i) Function key PF13

When a rotation operation is included in the reduction and expansion operation, the following expressions (5), (6) hold.

$$\begin{pmatrix} x' \\ y' \end{pmatrix} = \left\{ \begin{pmatrix} Sx & O \\ O & Sy \end{pmatrix} \begin{pmatrix} \cos\theta & -\sin\theta \\ \sin\theta & \cos\theta \end{pmatrix} \right\} \begin{pmatrix} x \\ y \end{pmatrix} \tag{5}$$

$$\begin{pmatrix} x \\ y \end{pmatrix} = \left\{ \begin{pmatrix} \cos\theta & \sin\theta \\ -\sin\theta & \cos\theta \end{pmatrix} \begin{pmatrix} \frac{1}{Sx} & O \\ O & \frac{1}{Sy} \end{pmatrix} \right\} \begin{pmatrix} x' \\ y' \end{pmatrix} \tag{6}$$

The expression (5) is that for obtaining a coordinate value on the D-plane 2 when Sx, Sy are expanded after the original graphic figure, or the graphic data on the S-plane 1 is rotated by $\theta$ counterclockwise, and the expression (6) indicates a back mapping of the expression (5).

The expansion, reduction and rotation operation 225 is ready according to the expression (5) or (6) by inputting the function key PF13, specifying Sx and Sy greater or less than 1, and further giving the rotated angle $\theta$, and the character font of a revised number of points is created on the current layer 222.

(j) Function key PF14

A rotation operation 228 of character fonts on the current layer 222 is carried out according to the following expression.

$$\begin{pmatrix} x' \\ y' \end{pmatrix} = \begin{pmatrix} \cos\theta & -\sin\theta \\ \sin\theta & \cos\theta \end{pmatrix} \begin{pmatrix} x \\ y \end{pmatrix}$$

The function key PF14 is inputted, and $\theta$ is specified accordingly, thereby activating the rotation operation 228 to rotate character fonts.

As will be apparent from the above description, according to this invention, if a character font pattern is once created and loaded in the font dictionary file, then it can be edited to such font pattern as is desired by a terminal user through interactive and visual operation or a revised character font pattern can be created through composing a plurality of font patterns without following again a procedure for creating a dot string data according to a printed character, thus saving the time for editing character fonts to a remarkable effect.

What is claimed is:

1. The interactive character font pattern creation, editing and composition control device comprising:

a file device for storing a font pattern;

a main storage;

a display screen;

operator-operable means for inputting a transfer command for effecting transfer of a font pattern between the file device and the main storage and a command for applying predetermined processings to the font pattern transferred to the main storage;

processor means for controlling the file device and the main storage to effect transfer of the font pattern from the file device to the main storage according to the transfer command and to effect said predetermined processings on the font pattern in response to the command for applying predetermined processings as inputted from the operator-operable means, and including means for controlling the displaying of one processed result of the processings on the display screen so as to enable an operator to indicate and execute a next predetermined processing by observing the result of a previous processing displayed on the display screen, including dot deletion and dot addition operations to effect modification of the dot pattern by operator interactive control, wherein a first font pattern storage and a second font pattern storage are provided in the main storage, said processor means comprising means for storing the font patterns read out of the file device alternately in the first font pattern storage and the second font pattern storage, thereby enabling a terminal operator to restore and display a processed result of one precedent command on the dispaly screen.

2. The interactive character font pattern creation, editing and composition control device comprising:

a file device for storing a front pattern;

a main storage;

a display screen;

operator-operable means for inputting a transfer command for effecting transfer of a font pattern between the file device and the main storage and a command for applying predetermined processings to the font pattern transferred to the main storage;

processor means for controlling the file device and the main storage to effect transfer of the font pattern from the file device to the main storage according to the transfer command and to effect said predetermined processings on the font pattern in response to the command for applying predetermined processings as inputted from the operator-operable means, and including means for controlling the displaying of one processed result of the processings on the display screen so as to enable an operator to indicate and execute a next predetermined processsing by observing the result of a previous processing displayed on the display screen, including dot deletion and dot addition operations to effect modification of the dot pattern by operator interactive control, wherein said main storage is provided with a plurality of font pattern storages therein and means including a control table for controlling the plurality of font pattern storages by storing attributes such as character font code, classification and size of a font style of the stored font patterns therein, said processor means comprising means for executing the predetermined processings by said means including the control table.

3. The interactive character font pattern creation, editing and composition control device as defined in claim 2, comprising control means for transferring the font patterns in said plurality of the font pattern storages in sequence to another font pattern storage by said means including said control table, thereby creating a revised font pattern.

4. The interactive character font pattern creation, editing and composition control device comprising:

a file device for storing a font pattern;

a main storage;

a display screen;

operator-operable means for inputting a transfer command for effecting transfer of a font pattern between the file device and the main storage and a command for applying predetermined processings to the font pattern transferred to the main storage;

processor means for controlling the file device and the main storage to effect transfer of the font pattern from the file device to the main storage according to the transfer command and to effect said predetermined processings on the font pattern in response to the command for applying predetermined processings as inputted from the operator-operable means, and including means for controlling the displaying of one processed result of the processings on the display screen so as to enable an operator to indicate and execute a next predetermined processing by observing the result of a previous processing displayed on the display screen, including dot deletion and dot addition operations to effect modification of the dot pattern by operator interactive control wherein said processor means comprises means for creating a font pattern identical in font style but different in size according to a command from said operator-operable means through expanding or reducing the font pattern laterally and vertically.

5. The interactive character font pattern creation, editing and composition control device as defined in claim 2, wherein said processor means includes means for expanding or reducing font pattern strings in the font pattern storages laterally and vertically so as to position them within the area of the display screen upon receipt of the command indicating that the terminal operator has difficulty in effecting a visual check through the operator-operable means for displaying the font patterns in said font pattern storages on the display screen.

6. The interactive character font pattern creation, editing and composition control device as defined in claim 5, wherein said processor means comprises means for transforming the font pattern into a coordinate value address in the font pattern storage prior to expanding or reducing the font pattern for display, and applies an editing to the font pattern in the font pattern storage, when the terminal operator specifies addition, deletion or move through the operator-operable means for a font pattern expanded or reduced for display by said processor means.

7. A character font pattern editing system comprising:

first storage means for storing a dot matrix representing a character font pattern;

display means;

input means operably by an operator for selectively inputting commands and for indicating an arbitrary selected position on a display screen of said display means;

processor means, including second storage means connected to said first storage means, said display means and said input means and responsive to a transfer comand inputted by said input means for transferring a dot matrix from said first storage means to said second storage means and responsive to input of one of a number of processing commands by said input means for executing a corresponding one of a plurality of predetermined processings to modify a dot matrix currently held by said second storage means, and including means for transferring to said dispaly means a new dot matrix held by said second storage means after execution of the transfer command or the one processing command, said processor means further including execution means responsive to input of a dot deletion command selected from the processing commands and to indication of a position by said input means for deleting a dot or dots at a position corresponding to the indicated position within a dot matrix currently held by said second storage means, and responsive to input of a dot addition command selected from said number of processing commands and to indication of a position by said input means for adding a dot or dots to a position corresponding to the indicated position within a dot matrix currently held by said second storage means;

whereby a new dot matrix for a character font pattern is obtained in said second storage means as a result of execution of an operator-determined sequence of selected processing commands; and wherein said execution means includes means responsive to input of the dot deletion command and to indication of a position for a single dot portion, a line portion or a plane portion on the display screen for deleting a dot located at a singel dot portion, dots located on a line portion or dots located in a plane portion, within a dot matrix held by said second storage means, respectively, corresponding to the indicated position for the single dot portion, the line portion or the plane portion on the display screen, and responsive to input of the dot addition command and to indication of a position for a singel dot portion, a line portion or a plane portion on the display screen for adding a dot to a single dot portion, dots to a line portion, or dots to a plane portion within a dot matrix held by said second storage means respectively, corresponding to the indicated position for the single dot portion, the line portion or the plane portion on the display screen; and wherein said processor means further includes means responsive to input of an expanded-display or zoomed-display command selected from the processing commands for transferring to said display means an expanded or zoomed dot matrix of a dot matrix held by said second storage means so that said expanded or zoomed dot matrix is displayed by said display means and responsive to succeeding input of a dot deletion command or a dot addition command and to indication by said input means of a single dot position, a line portion, or a plane portion for deleting a dot or dots from or adding a dot or dots to a corresponding single dot portion, a corresponding line portion or a corresponding plane poriton with a dot matrix held by said second storage means which respectively corresponds to the indicated single dot position, the indicated line portion or the indicated plane portion.

8. A character font pattern editing system comprising:

first storage means for storing a dot matrix representing a character font pattern;

display means;

input means operable by an operator for selectively inputting commands and for indicating an arbitrary selected position on a display screen of said display means;

processor means, including second storage means connected to said first storage means, said display means and said input means and responsive to a transfer command inputted by said input means for transferring a dot matrix from said first storage means to said second storage means and responsive to input of one of a number of processing commands by said input means for executing a corresponding one of a plurality of predetermined processings to modify a dot matrix currently held by said second storage means, and including means for transferring to said display means a new dot matrix held by said second storage means after execution of the transfer command or the one processing command, said processor means further including execution means responsive to input of a dot deletion command selected from the processing commands and to indication of a position by said input means for deleting a dot or dots at a position corresponding to the indicated position within a dot matrix currently held by said second storage means, and responsive to input of a dot addition command selected from said number of processing commands and to indication of a position by said input means for adding a dot or dots to a position corresponding to the indicated position within a dot matrix currently held by said second storage means;

whereby a new dot matrix for a charcter font pattern is obtained in said second storage means as a result of execution of an operator-determined sequence of selected processing commands; and wherein said processor means further includes means responsive to input of a scaling or zooming command selected from the processing commands for scaling or zooming a dot matrix held by said second storage means so that a scaled or zoomed dot matrix is newly held by said second storage means, thereby allowing an operator to thereafter input selected processing commands to modify the scaled or zoomed dot matrix so that a desired dot matrix for a scaled or zoomed character font pattern is stored in said second storage means as a result of execution of the selected processing commands.

9. A character font pattern editing system according to claim 8, wherein said processor means includes means responsive to input of a composition command provided after input of first and second transfer commands for combining all or part of a first dot matrix for a first character font pattern and all or part of a second dot matrix for a second character font pattern, respectively, transferred to said second storage means as a result of execution of said first and second transfer commands, so as to store a new dot matrix obtained as a result of the combination into said second storage means, thereby allowing the new dot matrix to be modified by succeeding input of a dot deletion command or a dot addition command so that the modified dot matrix can be used as a dot matrix for a third character font pattern.

10. A character font pattern editing system according to claim 13, wherein said processor means is operable to respond to said scaling or zooming command provided between said first transfer command and said composition command so as to scale or zoom the first dot matrix held by said second storage means, thereby allowing said processor means to compose the scaled or zoomed first dot matrix and the second dot matrix.

* * * * *